US008147199B2

(12) United States Patent
Tsai et al.

(10) Patent No.: US 8,147,199 B2
(45) Date of Patent: Apr. 3, 2012

(54) PUMP AND BALANCING COVER THEREOF

(75) Inventors: Shui-Fa Tsai, Taoyuan Hsien (TW); Hou-Chu Chen, Taoyuan Hsien (TW); Chin-Chu Hsu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1155 days.

(21) Appl. No.: 11/949,533

(22) Filed: Dec. 3, 2007

(65) Prior Publication Data

US 2008/0138193 A1 Jun. 12, 2008

(30) Foreign Application Priority Data

Dec. 8, 2006 (TW) ..... 95145988 A

(51) Int. Cl.
*F01D 25/06* (2006.01)

(52) U.S. Cl. ..... 416/144

(58) Field of Classification Search ..... 415/119; 416/144, 145; 29/889.3, 889.4; 417/423.6, 417/360
See application file for complete search history.

(56) References Cited

U.S. PATENT DOCUMENTS

2004/0247439 A1* 12/2004 Peng ..... 416/144
* cited by examiner

*Primary Examiner* — Edward Look
*Assistant Examiner* — Dwayne J White
(74) *Attorney, Agent, or Firm* — Birch, Stewart, Kolasch & Birch, LLP

(57) ABSTRACT

A balancing cover connected with a rotor structure includes a plate, a plurality of blades and at least one balancing element. A central portion of the plate has an opening. Each blade has one end connected with the plate and mounted on a circumference of the opening, and the other end connected with the rotor structure. Each blade has at least one hole, in which the balancing element is disposed.

18 Claims, 5 Drawing Sheets

PUMP AND BALANCING COVER THEREOF

CROSS REFERENCE TO RELATED APPLICATIONS

This Non-provisional application claims priority under 35 U.S.C. §119(a) on Patent Application No(s). 095145988 filed in Taiwan, Republic of China on Dec. 8, 2006, the entire contents of which are hereby incorporated by reference.

BACKGROUND OF THE INVENTION

1. Field of Invention

The invention relates to a pump and a balancing cover thereof, and in particular, to a pump capable of repeatedly adjusting rotation balanced amount, and a balancing cover thereof.

2. Related Art

A pump, such as a water pump, pumps up water from a low level to a high level. Therefore, the pump is widely used in the daily life to store the water in a water tower and to pump out a pool of water.

The basic requirement of the pump includes the good pumping efficiency. For example, a centrifugal pump has a rotor structure rotating at a proper rotating speed to drive blades to compress the fluid and then draw off the compressed fluid from an outlet so that the predetermined lift (vertical water path) and flow (i.e., the pumping water amount) can be obtained. The rotation balance of the rotor structure itself directly influences the force applied to a shaft of the pump, the vibration and the lifetime. So, the design of the rotor structure is very important.

Referring to FIG. 1A, a conventional centrifugal pump 1 includes a cover 11 and a rotor structure 12. The cover 11 has a plurality of first half blades 111 and an opening 112. The opening 112 is disposed in a central portion of the cover 11. The first half blade 111 is mounted on a circumference of the cover 11 and has at least one slot 1111 (see FIG. 1B). The rotor structure 12 has a plurality of second half blades 121 and a plurality of locking points 122. Each second half blade 121 has a blind hole 1211 and a locking claw 1212, and is mounted on a circumference of the rotor structure 12. The locking point 122 is mounted on the circumference of the rotor structure 12.

During the assembling process, the rotor structure 12 has to be individually balanced. That is, the eccentric mass is detected and calibrated. If the rotor structure 12 has the eccentric mass, a balancing pin 13 is inserted into the blind hole 1211 of the second half blade 121 of the rotor structure 12 at a position opposite to a position lacking the mass. The balancing operation is repeated until the rotor structure 12 satisfies the balanced specification. Next, when the rotor structure 12 and the cover 11 are assembled, the first half blade 111 of the cover 11 and the second half blade 121 of the rotor structure 12 are aligned and closed. Then, the cover 11 is rotated such that the first half blades 111 are respectively engaged with the locking claws 1212 of the second half blades 121. The first half blade 111 and the second half blade 121 form a complete blade, while the slot 1111 of the first half blade 111 engages with the locking point 122 so that the cover 11 is stably mounted on the rotor structure 12.

However, the rotor structure 12 is individually balanced, the cover 11 makes the overall pump 1 have the residual unbalanced amount after it is assembled with the cover 11. If the rotor structure 12 and the cover 11 have to be balanced again, the cover 11 and the rotor structure 12 have to be disassembled from each other so that the balancing pin 13 can be inserted. Typically, the balancing operation of the rotor structure 12 cannot be completed once. In addition, the balancing pin 13 cannot be easily taken out and then balanced again. If the balancing pin 13 has to be taken out, the cover 11 and the rotor structure 12 have to be disassembled and the cover 11 is thus damaged and cannot be used again. Accordingly, the cover 11 has to be replaced with another cover and the manufacturing cost is thus increased. Furthermore, because the complete blade is formed by the first half blade 111 of the cover 11 and the second half blade 121 of the rotor structure 12, an assembled seam is formed on a pressure surface (i.e., a drainage surface) to influence the water flow of pumping and thus to decrease the efficiency of the pump 1.

SUMMARY OF THE INVENTION

In view of the foregoing, the invention is to provide a pump, in which the rotation balance can be repeatedly adjusted so that the balancing operation is good and the usage efficiency can be ensured.

To achieve the above, a balancing cover according to the invention is connected with a rotor structure and includes a plate, a plurality of blades and at least one balancing element. A central portion of the plate has an opening. Each of the blades has one end connected with the plate and mounted on a circumference of the opening, and the other end connected with the rotor structure. Each blade has at least one hole, in which the balancing element is disposed.

In addition, a pump according to the invention includes a rotor structure and a balancing cover. The balancing cover is connected with the rotor structure and has a plate, a plurality of blades and at least one balancing element. A central portion of the plate has an opening. Each blade has one end connected with the plate and mounted on a circumference of the opening, and the other end connected with the rotor structure. Each blade has at least one hole, in which the balancing element is disposed.

As mentioned hereinabove, the pump and its balancing cover according to the invention have the following features. First, a plurality of complete blades is disposed in the balancing cover, and the blades are firmly connected with a rotor structure. Second, each blade has at least one hole for separately accommodating a balancing element so that the balancing element can be disposed in the hole or taken out from the hole according to the requirement. Compared with the prior art, the invention can balance the balancing cover and the rotor structure simultaneously after the balancing cover is connected with the rotor structure. So, the residual eccentric mass can be avoided and the rotation balance can be repeatedly adjusted so that the balancing operation is good, the usage efficiency can be ensured, the assembling yield can be enhanced, and the manufacturing cost can be reduced. In addition, the balancing cover has the complete blades, so the assembled seam, which is caused by the incomplete blades and influences the pumping flow field and thus deteriorates the pumping effect in the prior art, can be avoided, and the pumping efficiency of the present invention can be enhanced.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
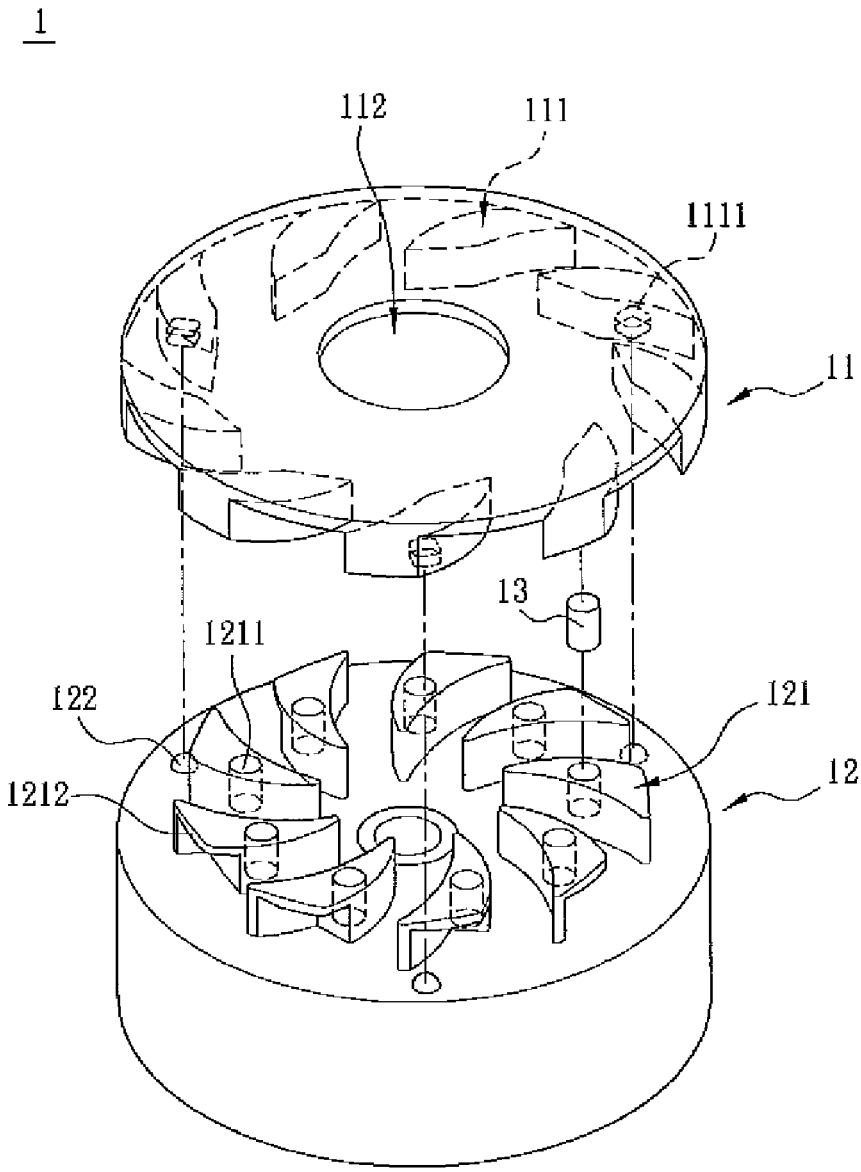
FIG. 1A(PRIOR ART)
FIG. 1A is an exploded view showing a centrifugal pump and its cover according to the prior art.
Figure 1B:
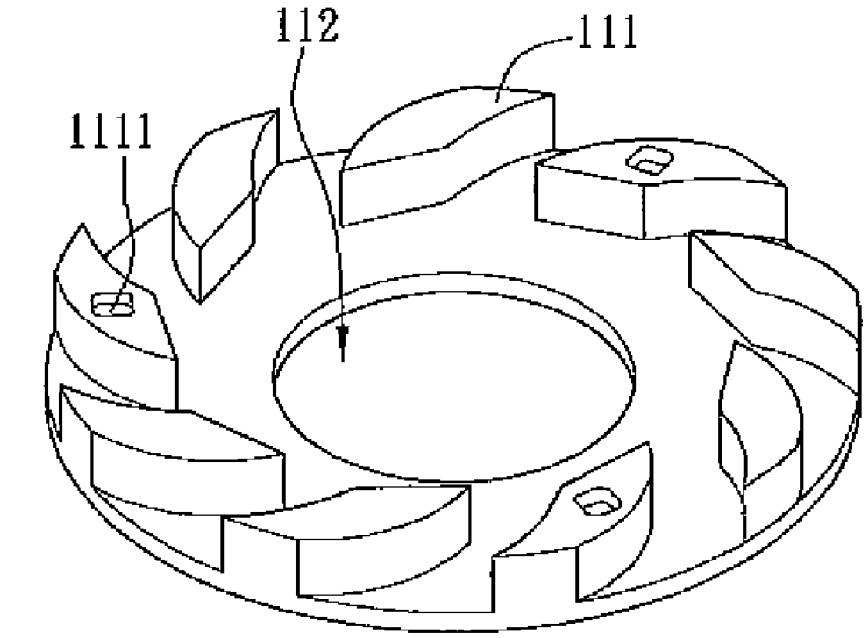
FIG. 1B(PRIOR ART)
FIG. 1B is a schematic illustration showing the cover of FIG. 1A.
Figure 2:
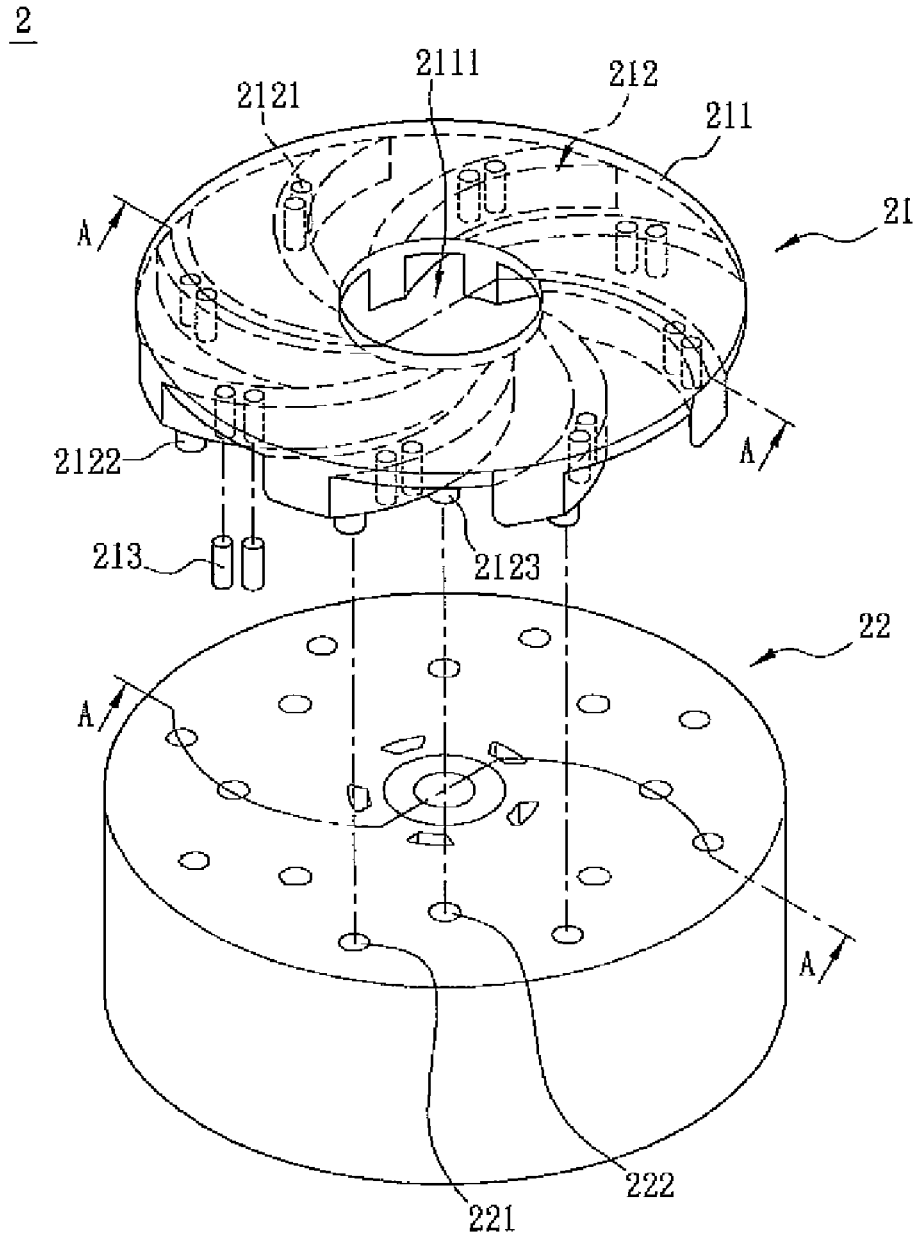
FIG. 2 is an exploded view showing a pump and its balancing cover according to an embodiment of the invention.
Figure 3:
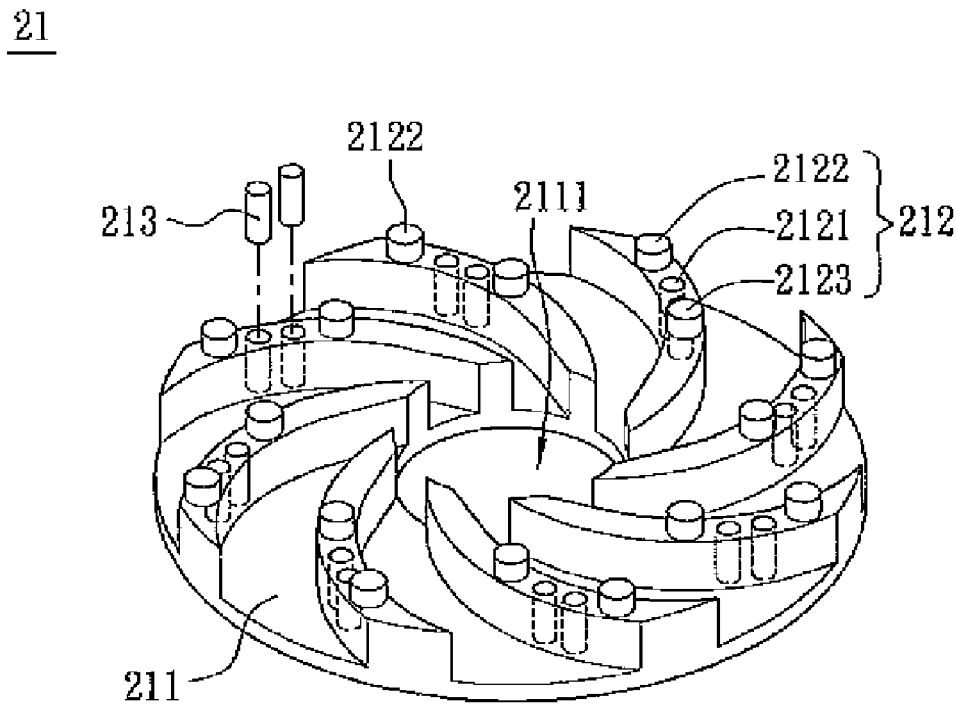
FIG. 3 is a schematic illustration showing the balancing cover of FIG. 2.

Referring to FIG. 2, a pump 2 according to an embodiment of the invention includes a balancing cover 21 and a rotor structure 22. The pump 2 of this embodiment may be implemented as a water pump or a centrifugal pump. Referring to FIGS. 2 and 3, the balancing cover 21 is connected with the rotor structure 22 and has a plate 211, a plurality of blades 212 and at least one balancing element 213. A central portion of the plate 211 has an opening 2111, which may be implemented as a circular opening and serve as an inlet of the water flow.

Each blade 212 has one end connected with the plate 211 and mounted on a circumference of the opening 2111, and the other end connected with the rotor structure 22. Each blade 212 has at least one hole 2121, a plurality of positioning members 2122 and a plurality of connecting elements 2123. In this embodiment, each blade 212 has, without limitation to, two holes 2121, one positioning member 2122 and one connecting element 2123. In addition, the holes 2121 are disposed between the positioning member 2122 and the connecting element 2123 and penetrate through the plate 211. The connecting element 2123 is disposed adjacent to the opening 2111 of the plate 211, and the positioning member 2122 is disposed adjacent to an outer edge of the plate 211. In addition, the arrangement of the blades 212 is not particularly restricted. In practice, the blades 212 may be arranged around a rotation center of the rotor structure 22 in a radial pattern or a vortex-like pattern. Each of the blades 212 is a complete blade having a shape that is not particularly restricted. However, the shape of the blade is continuous and smooth, such as a flat-plate-like shape, an arc shape or a wing-like shape, in order to enhance the smoothness of the water flow during pumping. In this embodiment, the blades 212 are arranged in the vortex-like pattern and have the arc shapes.

The material of each of the blades 212 and the plate 211 is not particularly restricted, may be selected from one of the group consisting of a plastic material, an acrylic material, a metal material, an alloy, a soft material or a rigid material and combinations thereof, and further may be a waterproof material. In addition, the blades 212 and the plate 211 may be integrally formed. Alternatively, the blades 212 may be adhered, engaged, embedded, screwed or welded with the plate 211. In this embodiment, the material of each of the blades 212 and the plate 211 is the plastic material. The blades 212 and the plate 211 are integrally formed.

The balancing element 213 may be engaged, embedded, or screwed in the hole 2121 of the blade 212. In this embodiment, the balancing element 213 is embedded into the hole 2121. The hole 2121 is located between the positioning member 2122 and the connecting element 2123, wherein the positioning member 2122 is adjacent to a periphery of the plate 211. The shape of the balancing element 213 is not particularly restricted and may be a rod-like shape, a pin-like shape or a block-like shape. The material of the balancing element 213 is also not particularly restricted, and may be a flexible material or a rigid material or may be a waterproof material. In addition, the shape of the balancing element 213 and the shape of the hole 2121 are substantially the same. That is, although the shape of the balancing element 213 is slightly different from the shape of the hole 2121, the balancing element 213 still can be fixed in the hole 2121 without a separating operation being performed. For example, the hole 2121 closed to a surface of the plate 211 has a diameter less than that closed to a surface of the blade 212. In this embodiment, the shapes of the balancing element 213 and the hole 2121 are circular rod-like shapes, as shown in the drawing.

Figure 4:
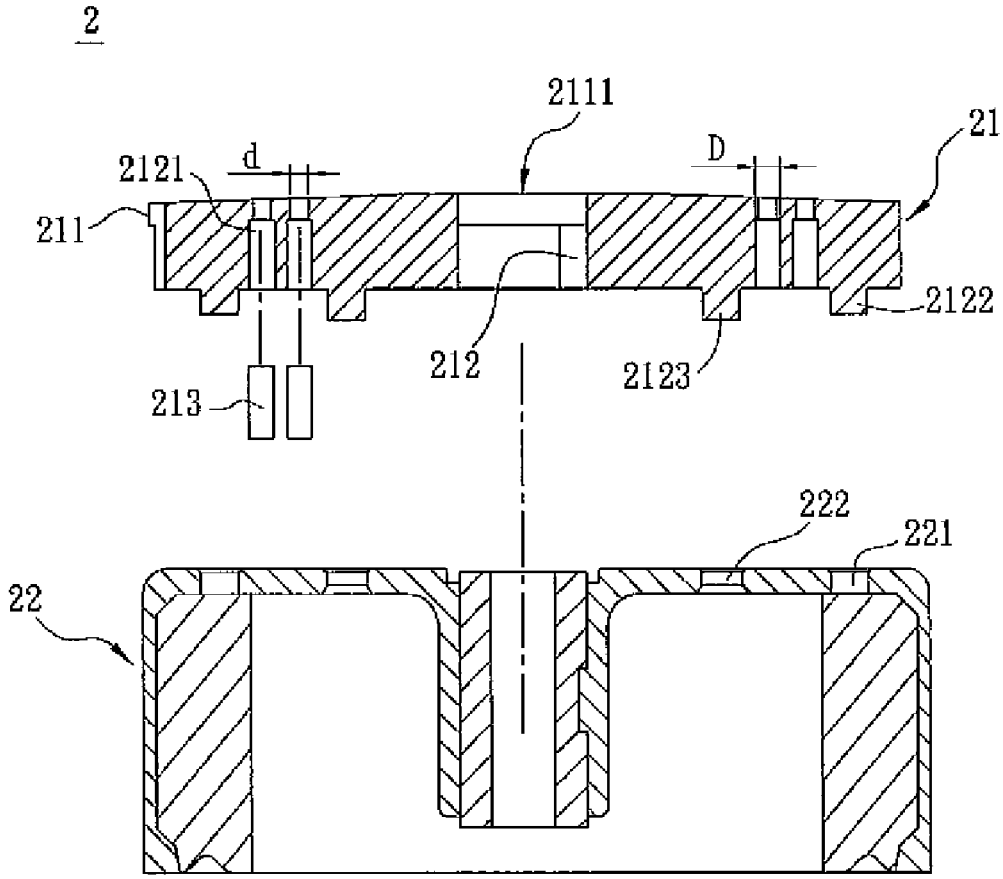
FIG. 4 is a cross-sectional view showing the pump according to the embodiment of the invention.

As shown in FIG. 4, the hole 2121 may have a step in order to prevent the water flow from flowing into the hole 2121 without the balancing element 213 and thus influencing the overall water flow. That is, the opening d close to the outer surface of the plate 211 is smaller than the opening D on the surface of the blade 212 so that the influence on the water flow is reduced and the balancing element 213 can be ensured to be separated when necessary.

The rotor structure 22 has a plurality of positioning portions 221 and a plurality of connecting portions 222. When the balancing cover is connected with the rotor structure, the positioning portions 221 are disposed corresponding to the positioning members 2122 of the balancing cover 21, respectively, and the connecting portions 222 are disposed corresponding to the connecting elements 2123 of the balancing cover 21, respectively. In addition, the positioning portion 221 and the connecting portion 222 are not particularly restricted and may be implemented as slots and holes such that the positioning member 2122 is disposed in the positioning portion 221 and the connecting element 2123 is disposed in the connecting portion 222 when the balancing cover 21 is connected with the rotor structure 22 by way of, for example, adhering, engaging, embedding, screwing or welding. Thus, the balancing cover 21 is firmly connected with the rotor structure 22 and cannot be easily separated from the rotor structure 22.

When the pump 2 is being balanced, the positioning member 2122 and the connecting element 2123 of the blade 212 are first connected with the positioning portion 221 and the connecting portion 222 of the rotor structure 22 so that the balancing cover 21 is fixed to the rotor structure 22. Then, the rotor structure 22 that has been connected with the balancing cover 21 is balanced. Therefore, the balancing cover 21 and the rotor structure 22 are simultaneously balanced to prevent the conventional residual eccentric mass. After the position of the eccentric mass is found, the balancing element 213 is disposed in the hole 2121 of the blade 212 corresponding to the position lacking the mass.

If the position of the balancing element 213 has to be adjusted, a tool may be utilized to take the balancing element 213 out of the hole 2121 so that the balancing element 213 is separated from the hole 2121. So, the reuse of the balancing cover 21 can be enhanced to make the balancing operation run well, and the usage efficiency is ensured. Therefore, the assembling yield can be enhanced and the manufacturing cost can be reduced.

In summary, the pump and its balancing cover according to the invention have the following features. First, a plurality of complete blades is disposed in the balancing cover, and the blades are firmly, connected with a rotor structure. Second, each blade has at least one hole for separately accommodating a balancing element so that the balancing element can be disposed in the hole or taken out from the hole according to the requirement. Compared with the prior art, the invention can avoid the existence of the residual eccentric mass and facilitate the repeated adjustment to make the balancing operation run well. Therefore, the usage efficiency can be ensured, the assembling yield can be enhanced, and the manufacturing cost can be reduced. In addition, the balancing cover has the complete blades, therefore, the assembled seam caused by the incomplete blades influences the pumping flow field and thus deteriorates the pumping effect in the prior art, can be avoided. In this way, the pumping efficiency of the invention can be enhanced.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A balancing cover adapted to be used with a rotor structure, comprising:

a plate disposed on the rotor structure;

a plurality of blades mounted on the plate, and having at least one hole; and at least one balancing element disposed in the hole; and at least one positioning member coupled to a positioning portion of the rotor structure by adhering, engaging, screwing or soldering when the balancing cover is connected with the rotor structure.

2. The cover according to claim 1, wherein the balancing element has a shape corresponding to that of the hole, the balancing element is engaged, embedded or screwed in the hole, and the balancing element is a rod-like element, a pin-like element or a block-like element.

3. The cover according to claim 1, wherein the plate has an opening, and the blades are mounted around the opening.

4. The cover according to claim 1, further comprising at least one connecting element coupled to a connecting portion of the rotor structure by adhering, engaging, screwing or soldering when the balancing cover is connected with the rotor structure.

5. The cover according to claim 4, wherein the hole is located between the positioning member and the connecting element, and the positioning member is adjacent to a periphery of the plate.

6. The cover according to claim 1, wherein the blades and the plate are integrally formed as a single piece, or the blades are adhered, engaged, embedded, screwed or welded with the plate and the rotor structure.

7. The cover according to claim 1, wherein the blades, the plate and the balancing element are made of a waterproof material, a plastic material, an acrylic material, a metal material, an alloy, soft material or rigid material.

8. The cover according to claim 1, wherein the blades have a flat-plate-like shape, an arc shape or a wing-like shape, and arranged about a rotation center of the rotor structure in a radial pattern or a vortex like pattern.

9. The cover according to claim 1, wherein the hole closest to a surface of the plate has a diameter less than that closest to a surface of the blade.

10. A pump comprising:

a rotor structure; and a balancing cover connected with the rotor structure and having a plate, a plurality of blades and at least one balancing element, wherein the plate is disposed on the rotor structure, the blades are mounted on the plate, and each of the blades has at least one hole in which the balancing element is disposed, and wherein the balancing cover further comprises at least one positioning member, coupled to at least one positioning portion of the rotor structure when the balancing cover is connected with the rotor structure.

11. The pump according to claim 10, wherein the balancing element has a shape corresponding to a shape of the hole, and the balancing element is engaged, embedded or screwed in the hole.

12. The pump according to claim 10, wherein the balancing element is a rod-like element, a pin-like element or a block-like element.

13. The pump according to claim 10, wherein a central portion of the plate has an opening, and the blades on the plate are mounted around the opening.

14. The pump according to claim 10, wherein the balancing cover further comprising at least one connecting element coupled to at least one connecting portion of the rotor structure when the balancing cover is connected with the rotor structure.

15. The pump according to claim 10, wherein the blades and the plate are integrally formed as a single unit, or the blades are adhered, engaged, embedded, screwed or welded with the plate and the rotor structure.

16. The pump according to claim 10, wherein the blades, the plate and the balancing element are made of a waterproof material, a plastic material, an acrylic material, a metal material or an alloy.

17. The pump according to claim 10, wherein the blades have a flat-plate-like shape, an arc shape or a wing-like shape, and the blades are arranged about a rotation center of the rotor structure in a radial pattern or a vortex-like pattern.

18. The pump according to claim 10, wherein the pump is a water pump or a centrifugal pump.

* * * * *